US006089633A

United States Patent [19]

Jacob

[11] Patent Number: 6,089,633

[45] Date of Patent: Jul. 18, 2000

[54] SHEET STACK HANDLER

[76] Inventor: Moses N. Jacob, 842 Victoria Street North, Kitchener, Ontario, Canada, N2B 3C1

[21] Appl. No.: 09/114,358

[22] Filed: Jul. 13, 1998

[51] Int. Cl.[7] ..... B66C 1/24

[52] U.S. Cl. ..... 294/67.22; 294/67.21; 294/67.5

[58] Field of Search ..... 294/67.21, 67.22; 414/626, 676, 903

[56] References Cited

U.S. PATENT DOCUMENTS 2,886,905 5/1959 Bayles ..... 294/67.22 X

FOREIGN PATENT DOCUMENTS 0233817 8/1987 European Pat. Off. ..... 294/67.22
4204343 8/1992 Germany ..... 294/67.22

OTHER PUBLICATIONS

Brochure entitled "POLAR Transomat E Unloading".
Brochure entitled "POLAR Stacklifts L–. . . –G/W–. . . ".
Brochure entitled "POLAR System 3".

*Primary Examiner*—Janice L. Krizek
*Attorney, Agent, or Firm*—Mark R. Wisner

[57] ABSTRACT

An apparatus for use in transporting a sheet stack comprises a wedge-shaped sheet stack holder with a cantilever arm extending from the back of the wedge. A suspending tether is joined to the cantilever arm. A primary tendon extends between the suspending tether and a lever joined to the stack holder. A secondary tendon extends between the suspending tether and the cantilever arm, passing over a clamp on the arm. When the lever is retracted, the stack support is suspended by the suspending tether and the primary tendon. When the lever is extended, the stack is supported by the suspending tether and the secondary tendon, thereby driving the clamp closed. The surface of the stack support arm comprises a dimpled air table.

9 Claims, 4 Drawing Sheets

SHEET STACK HANDLER

FIELD OF INVENTION

This invention relates to a device for handling sheet stacks and, more particularly, to a device capable of loading, transporting, and unloading stacks of sheets.

BACKGROUND OF THE INVENTION

Paper mills supply paper to paper merchants, converters and printing companies in the form of large sheets and rolls. The rolls are sheeted into large sheets of paper and then stacked. These large sheets of paper are usually too large for the needs of final consumers so they are further cut into smaller sizes by a variety of commercial paper cutters. After being cut to size the sheets of paper are again stacked for packaging.

Known commercial paper cutters, such as the POLAR (tm) made by Polar, can be loaded and unloaded manually. However, multiple large sheets of paper are awkward to handle manually and can be very heavy. Furthermore, most commercial paper cutters can cut paper faster than it can be manually loaded or unloaded. Thus, manual loading and unloading results in an inefficient bottleneck in the paper cutting process.

Most existing loader/unloaders, such as the POLAR TRANSOMAT E paper unloader, can easily handle multiple large sheets of paper and increase the speed of commercial paper cutters to improve process efficiency. However, these commercial unloaders are: (1) very expensive, and (2) large, requiring significant floor space. These disadvantages are multiplied by the fact that two of these commercial unloaders are typically required for the paper cutting process: one is required to unload the paper from the raw paper stack to the cutter and the second is required to unload the paper from the cutter onto the finished paper stack.

SUMMARY OF THE INVENTION

The present invention attempts to overcome disadvantages of existing loader/unloaders, in so far as it requires no floor space, is easy to operate, inexpensive, fast and able to operate both as a loader and unloader for raw and finished product. The present invention can also be used in other areas of the printing process, eg. loading product onto printing presses or transferring product between skids. It also substantially reduces the possibility of operator back or muscle injury, caused by the constant handling of heavy product.

In accordance with an aspect of the present invention, there is provided an apparatus for use in transporting a sheet stack, comprising: a support arm, comprising a wedge shaped air table tapering to a free end; and a cantilevered arm extending from the support arm distal from the free end of the wedge shaped air table such that a portion of the cantilevered arm overlies the wedge shaped air table, the cantilevered arm having a suspending tether attachment point for receiving a suspending tether.

In accordance with another aspect of the invention there is provided an apparatus for use in transporting a sheet stack comprising: a displaceable support having a first tendon attachment point and being displaceable between a retracted position and extended position; an arm having a suspending tether attachment point and second tendon attachment point; the displaceable support being supported by the arm; a suspending tether attached to the suspending tether attachment point; a first tendon attached to the first tendon attachment point and to the suspending tether; a second tendon attached to the second tendon attachment point and to the suspending tether; the first tendon and the second tendon having a length, and the suspending tether attachment point, first tendon attachment point and second tendon attachment point arranged, such that when the arm is suspended by the suspending tether, (i) the first tendon is tensioned and the second tendon is slack when the displaceable support is in the retracted position, so that the arm is suspended at one angle by the suspending tether and the first tendon, and (ii) the first tendon is slack and the second tendon is tensioned when the displaceable support is in the extended position, so that the arm is suspended at a second angle by the suspending tether and the second tendon.

BRIEF DESCRIPTION OF THE DRAWINGS

In the figures which illustrate, by way of example, embodiments of the present invention.

DETAILED DESCRIPTION OF THE PREFERRED EMBODIMENTS

Figure 1:
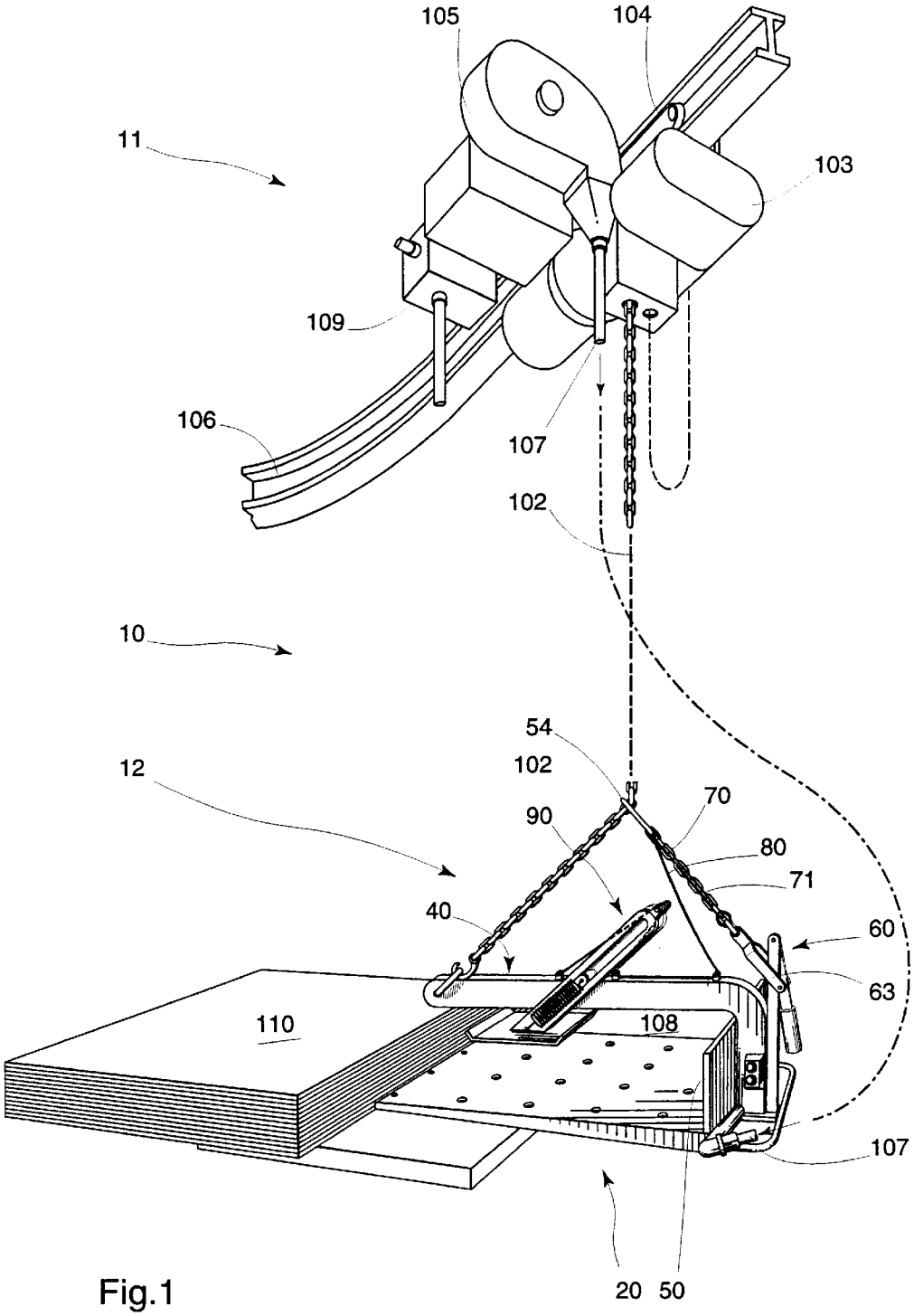
FIG. 1 is a perspective view of a stack handling device in accordance with a preferred embodiment of the present invention.

Referencing FIG. 1, a sheet stack handling device 10 comprises a support 11 and a paper stack holder 12.

Support 11 comprises a hoist 103 and a compressor 105 attached to a trolley 104 which rides on a gently sloped rail 106. A suspending tether 102 extending from hoist 103 suspends holder 12 and permits the holder 12 to be swung under a sheet stack during loading of a sheet stack. Hoist 103 may retract or extend suspending tether 102 so that the vertical position of holder 12 may be adjusted. Trolley 104 runs along the length of rail 106. Rail 106 may itself be moveable (not shown) so that the horizontal position of holder 12 may then be adjusted to any position within the work space. Alternatively, if stationary, rail 106 allows holder 12 to move horizontally along a predetermined path.

Hoist 103 and compressor 105 have their own motors (not shown) which are powered through junction box 109.

Compressor 105 supplies low pressure compressed air to holder 12 through conduit 107, which extends between compressor 105 and holder 12.

Holder 12 comprises a stack support arm 20 joined at one end to the base of a cantilever arm 40. The cantilever arm 40 supports a clamp 90. A non-self supporting primary suspending tendon 70 and an elastic member 71 are joined at one end to tether 102 and at their other end to a wishbone yoke 63. The yoke 63 is attached to a displaceable support in the nature of a lever 60 which extends from the base of cantilever arm 40. A non-self supporting secondary suspending tendon 80 is joined at one end to tether 102 and passes around a clamp 90 and is joined at its other end to cantilever arm 40.

Cantilever arm 40 acts as the backbone of holder 12. More particularly, cantilever arm 40 supports stack support arm 20, lever 60 and clamp 90. Cantilever arm 40 is suspended by suspending tether 102 and one of primary suspending tendon 70 and secondary suspending tendon 80.

Lever 60 is used to alternate suspension between primary suspending tendon 70 and secondary suspending tendon 80. When lever 60 is retracted, holder 12 is suspended by suspending tether 102 and primary suspending tendon 70. Yoke 63 prevents primary suspending tendon 70 from entangling with lever 60. When lever 60 is extended, holder 12 is suspended by suspending tether 102 and secondary suspending tendon 80. With lever 60 extended, the secondary suspending tendon 80 activates clamp 90. Furthermore, elastic member 71, which may be, for example, a spring, keeps the extended lever 60 and yoke 63 in tension, preventing them from falling into or contacting secondary suspending tendon 80.

In overview, stack support arm 20 is used to support sheet stacks during transport through the workspace with clamp 90 securing sheet stacks on stack support arm 20.

Figure 2:
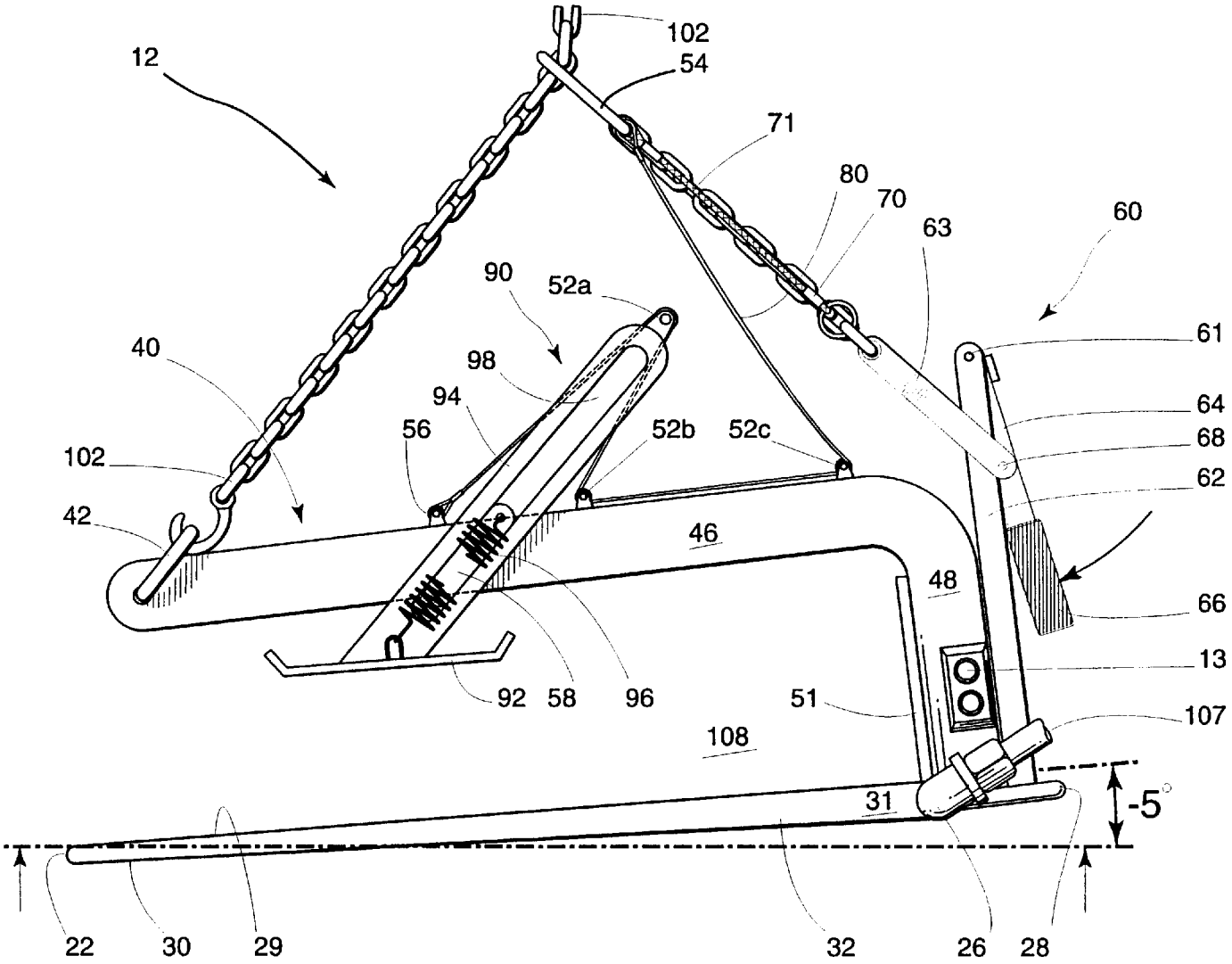
FIG. 2 is a side view of a portion of the stack handling device of FIG. 1 configured for loading and unloading a stack.
Figure 3:
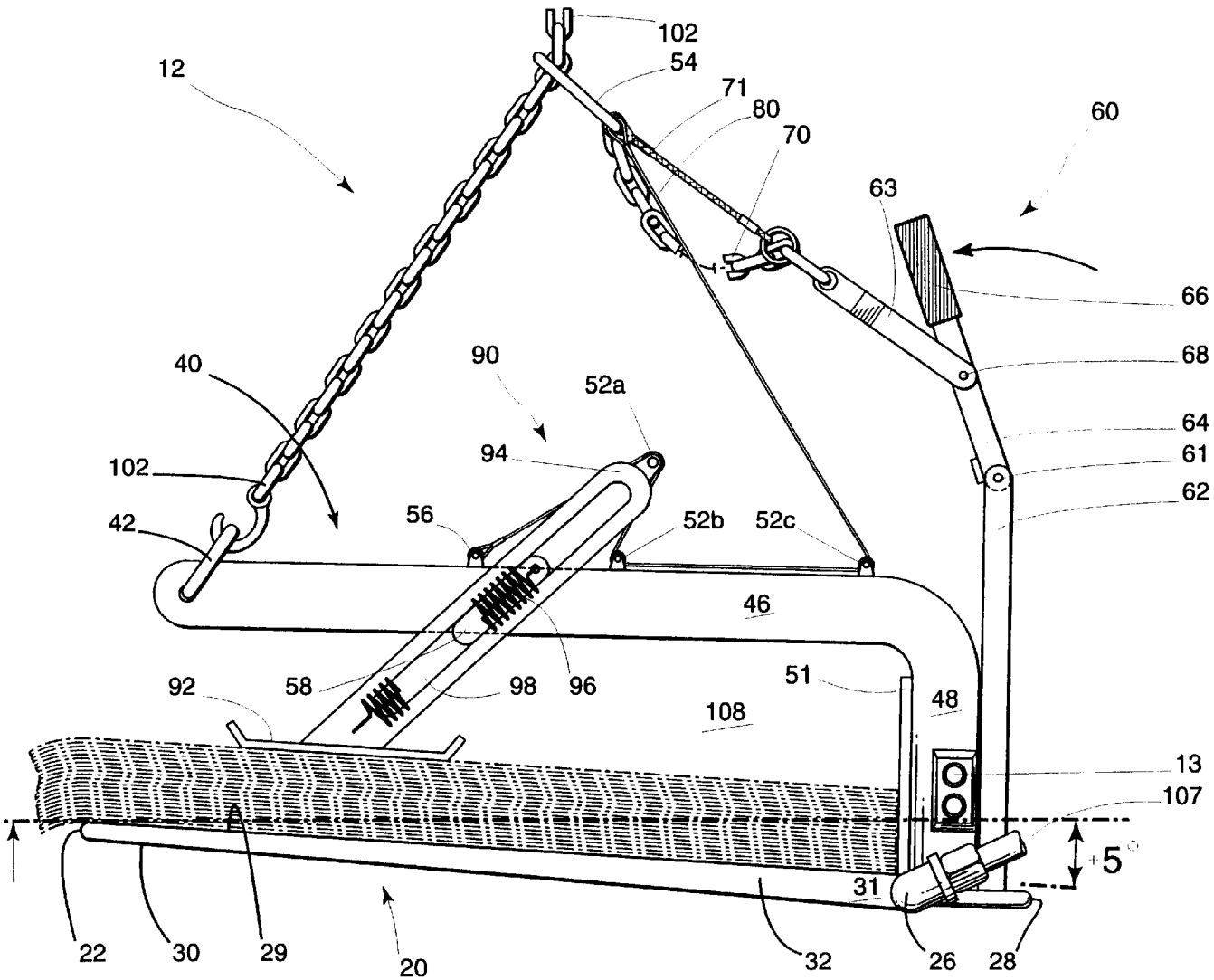
FIG. 3 is a side view of a portion of the stack handling device of FIG. 1 configured for transporting a stack.
Figure 4:
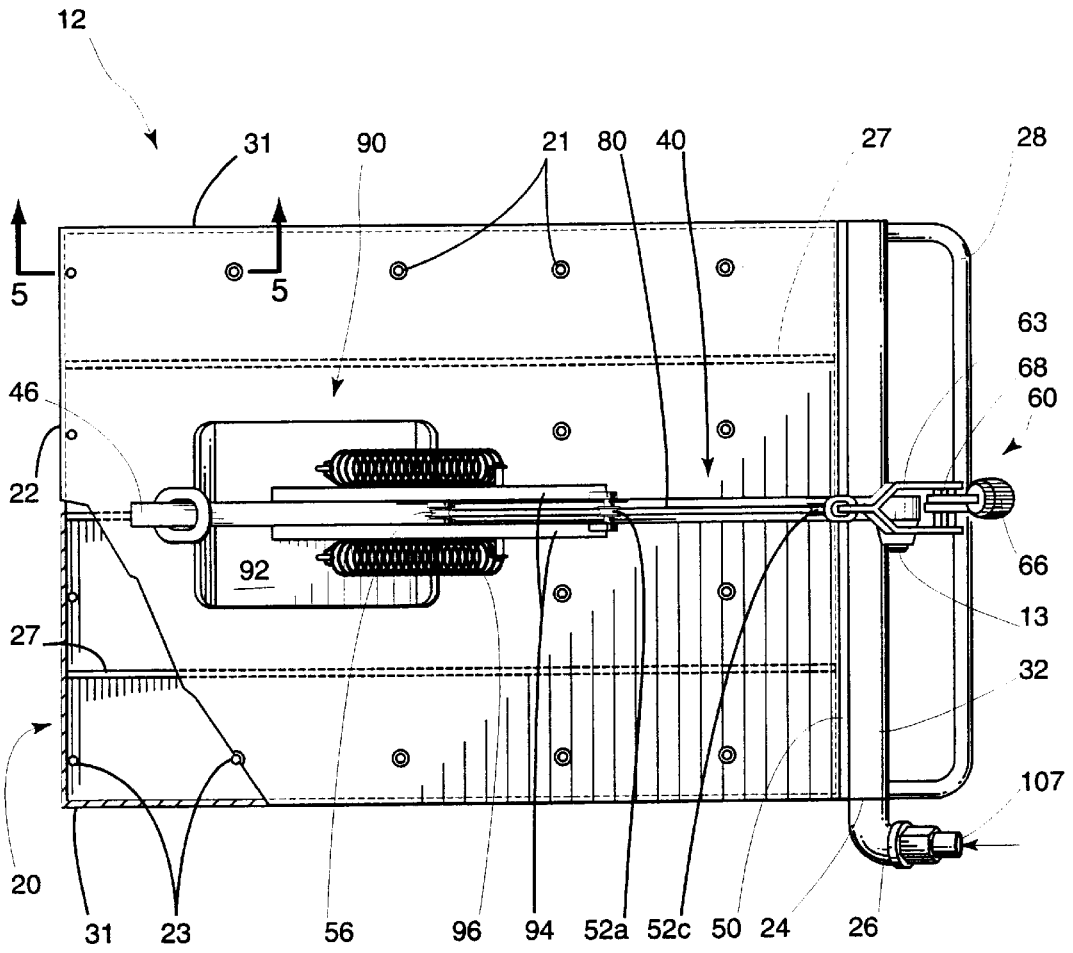
FIG. 4 is a top view of the stack handling device.

Referring to FIGS. 2–4, stack support arm 20 is generally wedge shaped having an interior plenum 25 defined by a top surface 29, a bottom surface 30, a thick end 32, a tapered end 22 and a pair of side walls 31. Stack support arm 20 is made of steel or any other suitably rigid material. A series of evenly spaced reinforcing walls 27 parallel side walls 31 and extend between top surface 29 and bottom surface 30 adding strength and rigidity to stack support arm 20.

Tapered end 22 is rounded to prevent sheet stack damage during loading and unloading.

Figure 5:
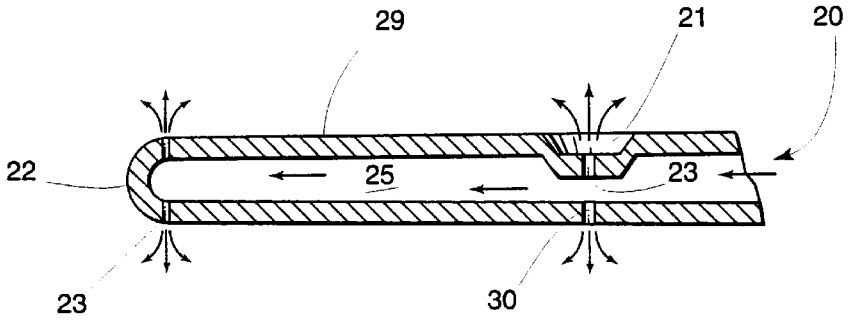
FIG. 5 is a cross-sectional view taken along the line 5—5 of FIG. 4.

Referring to FIGS. 4 and 5, top surface 29 is covered with a plurality of dimples 21, each of the dimples having an air supply opening 23 extending into plenum 25. Top surface 29 also has a row of air supply openings proximate tapered end 22 without dimples as the tapered end 22 of stack support arm 20 is too thin to accommodate dimples. Bottom surface 30 is also provided with a plurality of air supply openings extending into plenum 25.

Referring to FIGS. 1 and 4, a bore 24 extends through one of side walls 31. Extending out from bore 24 is a fitting 26 releasably connected to conduit 107. When compressor 105 is activated, low pressure air is communicated to plenum 25 through conduit 107 and fitting 26. This causes pressure in the plenum 25 to rise above ambient pressure which forces air out through air supply openings 23.

A person skilled in the art will recognize that a rise of pressure within plenum 25 acts to reduce friction between a sheet stack in contact with top surface 29. Similarly, a rise of pressure within plenum 25 acts to reduce friction between bottom surface 30 in contact with a sheet stack or table below the portion of the stack being loaded. It will be appreciated that this reduction of friction may be used to facilitate loading and unloading of a sheet stack.

Note that the surface area of dimples 21 is greater than the surface area of air supply openings 23. This increased surface area provides distinct benefits when a sheet stack covers all or only some of the dimples 21.

In a case where all of the top surface of air supply openings 23 are covered, pressure within plenum 25 will rise until the sheet stack is slightly lifted off of top surface 29 so that static friction between the sheet stack and top surface 29 is broken. At this point air will escape through air supply openings 23 between the sheet stack and top surface 29 and the pressure within plenum 25 will reach equilibrium. It will be appreciated that dimples 21 increase the area of exposure of the sheet stack to the pressure so that the sheet stack will be lifted with less pressure in plenum 25 than would be required without dimples 21. Accordingly, a smaller pressure may be used to raise the sheet stack and thus a smaller compressor 105 may be employed.

In the case when a sheet stack does not cover all of the air supply openings 23 on top surface 29, air will continuously escape through the air supply openings 23 that are not covered. Since air can continuously escape through the uncovered air supply openings 23, the increase of pressure within plenum 25 will not be as great as in the first case. Nevertheless, by increasing the area of exposure of the stack to the pressurized air, the presence of dimples 21 will still reduce the force of friction to a greater degree than air supply openings 23 would on their own with the same pressure. Since a lower pressure is needed to effect the same reduction in friction, a smaller compressor 105 may be used.

Friction with the sheet stack may further be reduced by coating top surface 29 and bottom surface 30 with a substance, like TEFLON (tm), that has a low co-efficient of friction.

A support arm handle 28 is attached to the back of thick end 32.

Cantilever arm 40 is generally "L" shaped comprising a basal lower arm 48 and an upper arm 46. Lower arm 48 extends upwards from the middle of thick end 32 of support arm 20 to upper arm 46 which extends outwardly over stack support arm 20, substantially parallel to its top surface 29.

From a side-view, in FIG. 2 or FIG. 3, cantilever arm 40 and stack support arm 20 generally form a "C" shape, wherein the interior of the "C" shape defines a sheet stack receiving space 108.

An operator control panel 13, comprising controls for hoist 103 and compressor 105 is affixed to the lower arm 48 of cantilever arm 40.

A backplate 50 extends across the back of stack support arm 20 perpendicular to top surface 29 and is affixed to lower arm 48. Backplate 50 defines the back of sheet stack receiving space 108 and serves as a back-stop for sheet stacks during sheet stack loading and transport.

Referencing FIG. 2, a first cantilever arm mount for suspending tether 102 comprises a ring 42 received by the free end of upper arm 46.

As seen in FIGS. 3 and 4, two symmetrical clamp guides 58 extend outward from either side of cantilever arm 40. As will be explained, clamp guides 58 engage clamp 90 and define the direction along which clamp 90 may extend or retract.

Clamp 90 comprises a pair of symmetrical oblong bodies 94, each defining a channel 98 and terminating in a common foot 92. Oblong bodies 94 are joined to each other on either side of cantilever arm 40 whereby the channels 98 in oblong bodies 94 receive clamp guides 58. With lever 60 retracted, a pair of springs 96 bias clamp 90 in a retracted position so that clamp 90 does not engage sheet stacks during the loading and unloading process. This is achieved by attaching one end of each spring 96 to clamp guides 58 and the other end to foot 92.

Foot 92 is responsible for pressing down upon the surface of sheet stacks during clamping. Foot 92 generally comprises a flat rectangular plate with the front and back edges bent upwards to avoid damaging sheet stacks during clamping. Foot 92 is affixed to the bottom of oblong bodies 94 so that it is parallel with top surface 29. In this way, when clamp 90 is extended, the whole surface of foot 92 will contact the top of the sheet stack to assist in securing the sheet stack in place.

Lever 60 comprises a stationary post 62 and a lever arm 64. Post 62 is attached to the back of lower arm 48 of cantilever arm 40 so that it extends upwardly. Lever arm 64 is pinned at pivot 61 on the upper end of post 62 so that lever arm 64 may pivot between a retracted and an extended position. The end of lever arm 64 is provided with a handle 66. Pin 68, which attaches yoke 63 to lever arm 64, also acts to prevent over-rotating of the lever arm 64 in the retracted position.

Primary support tendon 70, which typically comprises a cable, rope or chain, extends between a tether mount 54, which is attached to suspending tether 102 above cantilever arm 40, and the tip of yoke 63. Because tether mount 54 is forward of post 62 and pivot 61, the lever arm 64 is overcentre when it is rotated rearwardly so that pin 68 abuts post 62. Consequently, any tension in primary support tendon 70 biases lever arm 64 against pin 68.

As illustrated in FIG. 2, primary support tendon 70 has a length such that, when lever 60 is retracted, primary support tendon 70 in combination with suspending tether 102 suspend holder 12 so that top surface 29 has a negative angle of about five degrees below horizontal, whereby tapered end 22 is lower than thick end 32. As will be explained, there are certain advantages in having a top surface 29 with a negative angle during the loading and unloading process.

Secondary support tendon 80, which typically comprises a cable, chain or rope, extends between tether mount 54 and a second cantilever arm mount 56 in the form of an attachment point, which is located on cantilever arm 40 between mount 42 and clamp guides 58. In the preferred embodiment, secondary support tendon 80 is redirected by three pulleys 52*a,* 52*b* and 52*c*. Pulley 52*a* is supported at the top of clamp 90 and pulleys 52*b* and 52*c* are supported by cantilever arm 40 so that tension in secondary support tendon 80 will act to extend clamp 90.

Secondary support tendon 80 has a length such that when lever 60 is retracted primary support tendon 70 is in tension and secondary support tendon 80 is slack so that clamp 90 remains fully retracted. The length of secondary support tendon 80 and the location of pulleys 52*a,* 52*a* and 52*c* are arranged such that when lever 60 is extended primary support tendon 70 is slack and secondary support tendon 80 is in tension which causes clamp 90 to extend. Secondary support tendon 80 in combination with suspending tether 102 will suspend holder 12 so that top surface 29 has a positive angle of up to five degrees above horizontal as illustrated in FIG. 3. The angle of top surface 29 is proportional to the length of secondary support tendon 80 between tether mount 54 and third pulley 52*c*. As clamp 90 is extended the length of secondary support tendon 80 between tether mount 54 and third pulley 52*c* increases. It will be appreciated that the exact angle of top surface 29 will depend on how far clamp 90 is extended. Accordingly, the smaller the sheet stack supported by stack support arm 20 the further clamp 90 will extend and the greater the angle of top surface 29 will be (to a maximum of about five degrees above the horizontal). During transport of sheet stacks it is advantageous to have a top surface 29 with a positive angle so that the sheet stacks will be tilted toward backplate 50.

Device 10 has three distinct modes of operation: loading, transport, and unloading of sheet stacks.

In order to load a sheet stack onto stack support arm 20, holder 12 is positioned using the controls on control panel 13 so that tapered end 22 faces the bottom edge of the sheet stack sought to be loaded. Lever 60 is moved to its retracted position, as illustrated in FIG. 2, so that clamp 90 is fully retracted and top surface 29 has a negative angle. The bottom edge of the sheet stack may then be manually lifted so that tapered end 22 may be inserted underneath. Next, compressor 105 is activated so that any friction acting upon top surface 29 and bottom surface 30 will be reduced. Holder 12 is then pushed under the sheet stack until the sheet stack abuts against backplate 50.

Once a sheet stack has been loaded onto stack support arm 20, compressor 105 is de-activated so that friction will assist in keeping the sheet stack in place. Holder 12 is raised slightly with hoist 103 to avoid contact between bottom surface 30 and the remaining sheet stack or table below the loaded sheet stack when secondary suspending tendon 80 is tensioned. Next, referencing FIG. 3, secondary suspending tendon 80 is tensioned by extending lever 60 so that clamp 90 extends, securing the sheet stack in place, and top surface 29 has a positive angle, tilting the sheet stack 110 toward backplate 50. Finally, holder 12 with the sheet stack may be moved through the workspace and positioned using the controls on control panel 13 so that the sheet stack is directly over the location where it is sought to be unloaded.

In order to unload the sheet stack, clamp 90 is retracted and top surface 29 is tilted forward by again retracting lever 60, as seen in FIG. 2. Next, compressor 105 is activated so that friction between the sheet stack and top surface 29 is reduced. (Similarly, any friction acting upon bottom surface 30 will also be reduced.) Finally, with little effort, the sheet stack may be manually pushed into the desired unloading location (or the stack may be held in place while the paper stack holder 12 is withdrawn). In the unloading step the negative angle of top surface 29 makes it easier to push the sheet stack off of stack support arm 20.

Cantilever arm 40 may be replaced by any other suitable superstructure providing a mount for tether 102, primary suspending tendon 70 and secondary suspending tendon 80. In this regard, while it is preferred that tether mount 54 is a ring joining tendons 70 and 80 to tether 102, tether mount 54 could be any other permanent or releasable mount. Also, tether mount 54 could be replaced by a pair of mounts, one for each of tendons 70 and 80. These separate mounts could mount the tendons at spaced locations on tether 102.

It is further contemplated that a plurality of means for effecting mounts including rings, pins or clamps, could be used without departing from the spirit and scope of this invention.

It is further contemplated that the economical friction reducing dimple 23 and air supply opening 21 combination described in the present disclosure could be replaced with a more traditional air hole/ball/spring arrangement found in many air tables. Indeed, for some applications, the stack handler could function adequately with no pressurized air at all.

It is further contemplated that some applications may require a trolley 104 be motorized to assist in moving handling device 10 and/or a breaking mechanism to stop trolley 104 at loading and unloading points. However, in most instances, as in the preferred embodiment, it is sufficient to provide rail 106 with a slight downward gradient from the loading point to the unloading point and to arrange for unloading and loading motions to be perpendicular to the length of rail 106.

Although top surface 29 is described in the present disclosure as having a negative angle of five degrees during the loading and unloading process and a positive angle of up to five degrees during the transport process it will be appreciated that these angles can be varied without significantly affecting the operation of this invention.

It will also be appreciated that the relative dimensions of device 10 may be varied to accommodate different sheet sizes, including but not limited to: the width of stack support arm 20, the height of stack receiving space 108 and the distance which clamp 90 extends.

Finally, it will be obvious that the order of operations described in the present disclosure may be varied.

The sheet stacks may be stacks of paper, card stock, or other sheets.

Accordingly, a device for handling sheet stacks is provided which has inherently all those attributes, objects and advantages set forth above, and which provides a new and useful article of manufacture of a type and function unique in light of prior constructions.

In the foregoing description certain terms have been used for brevity, clearness and understanding, but no unnecessary limitations are to be implied therefrom beyond the requirements of the prior art, because such words are used for descriptive purposes herein and are intended to be broadly construed.

Moreover, the embodiments of the improved construction illustrated and described herein are by way of example, and the scope of the invention is not limited to the exact details of construction.

Having now described the invention, the construction, the operation and use of preferred embodiments thereof, and the advantageous new and useful results obtained thereby, the new and useful construction, and reasonable mechanical equivalents thereof obvious to those skilled in the art, are set forth in the appended claims.

What is claimed is:

1. An apparatus for use in transporting a sheet stack comprising:

(a) a displaceable support having a first tendon attachment point and being displaceable between a retracted position and an extended position;

(b) an arm having a suspending tether attachment point and a second tendon attachment point;

said displaceable support being supported by said arm;

(c) a suspending tether attached to said suspending tether attachment point;

(d) a first tendon attached to said first tendon attachment point and to said suspending tether;

(e) a second tendon attached to said second tendon attachment point and to said suspending tether;

said first tendon and said second tendon having a length, and said suspending tether attachment point, first tendon attachment point and second tendon attachment point arranged, such that when said arm is suspended by said suspending tether, (i) said first tendon is tensioned and said second tendon is slack when said displaceable support is in the retracted position, so that said arm is suspended at one angle by said suspending tether and said first tendon, and (ii) said first tendon is slack and said second tendon is tensioned when said displaceable support is in the extended position, so that said arm is suspended at a second angle by said suspending tether and said second tendon.

2. The apparatus of claim 1 further comprising:

(f) a tendon mount mounted to said suspending tether above said arm;

said first tendon and said second tendon being attached to said suspending tether at said tendon mount.

3. The apparatus of claim 2 wherein said arm is a cantilevered arm, and including a stack support arm attached to said cantilevered arm such that a portion of said cantilevered arm overlies said stack support arm, said stack support arm having a wedge shaped body tapering to a free end.

4. The apparatus of claim 3 wherein said wedge shaped body has an outer surface coated with a low friction substance.

5. The apparatus of claim 4 wherein said cantilevered arm extends distal from the free end of said wedge shaped body of said stack support arm.

6. The apparatus of claim 5 further comprising:

(g) a clamp affixed to said cantilevered arm.

7. The apparatus of claim 6 wherein said clamp reciprocals between a retracted inoperative position and an extended clamping position, wherein said clamp is biased to the retracted inoperative position, said apparatus farther comprising:

(h) a tendon redirector mounted to said cantilevered arm; and (i) a tendon redirector mounted to said clamp;

said second tendon extending from said tendon mount, under said cantilevered arm mounted tendon redirector and over said clamp mounted tendon redirector to said second tendon attachment point so that said clamp extends when said second tendon is tensioned and so that said clamp retracts when said second tendon is slack.

8. The apparatus of claim 7 wherein said wedge shaped body is an air table.

9. The apparatus of claim 8 wherein said air table has an interior plenum with an air supply opening to each of a series of concave dimples in a top surface of said air table.

* * * * *

UNITED STATES PATENT AND TRADEMARK OFFICE

CERTIFICATE OF CORRECTION

PATENT NO. : 6,089,633
DATED : July 18, 1998
INVENTOR(S) : Moses N. Jacob

It is certified that error appears in the above-identified patent and that said Letters Patent is hereby corrected as shown below:

Column 8,
Line 29, delete "reciprocals" and insert -- reciprocates --
Line 32, delete "farther" and insert -- further --

Signed and Sealed this

Sixteenth Day of October, 2001

*Attest:*

Nicholas P. Godici

NICHOLAS P. GODICI
*Acting Director of the United States Patent and Trademark Office*

*Attesting Officer*